United States Patent [19]

Rüppell

[11] Patent Number: 4,461,653

[45] Date of Patent: Jul. 24, 1984

[54] METHOD FOR REDUCING HEAT LOSS IN A BOTTLE CLEANING MACHINE

[75] Inventor: Christian Rüppell, Unna, Fed. Rep. of Germany

[73] Assignee: Holstein und Kappert GmbH, Dortmund, Fed. Rep. of Germany

[21] Appl. No.: 457,134

[22] Filed: Jan. 11, 1983

Related U.S. Application Data

[63] Continuation of Ser. No. 230,068, Jan. 29, 1981, abandoned.

[30] Foreign Application Priority Data

Feb. 1, 1980 [DE] Fed. Rep. of Germany ..... 3003663

[51] Int. Cl.[3] ..... B08B 3/10

[52] U.S. Cl. ..... 134/10; 134/23; 134/25.4; 134/29; 134/30; 134/107; 134/108

[58] Field of Search ..... 134/10, 23, 25.2, 25.4, 134/25.5, 29, 30, 60, 107, 108

[56] References Cited

U.S. PATENT DOCUMENTS

| | | | |
|---|---|---|---|
| 1,719,410 | 7/1929 | Webb | 134/107 X |
| 2,133,481 | 10/1938 | Schroeder | 134/107 X |
| 2,681,872 | 6/1954 | McCabe | 134/30 X |
| 3,951,158 | 4/1976 | Tedden | 134/60 |
| 4,154,624 | 5/1979 | Wahl et al. | 134/10 |
| 4,185,647 | 1/1980 | Babunovic | 134/108 X |

FOREIGN PATENT DOCUMENTS

| | | | |
|---|---|---|---|
| 1153281 | 8/1963 | Fed. Rep. of Germany | 134/60 |

*Primary Examiner*—Marc L. Caroff

*Attorney, Agent, or Firm*—Toren, McGeady and Stanger

[57] ABSTRACT

Heat losses in a bottle cleaning machine are kept to a minimum by recirculating a first liquid from a pre-heating zone, where the bottles are showered with the first liquid, in indirect heat transfer relationship with a recirculating second liquid from a re-cooling zone, where the bottles are showered with the second liquid.

2 Claims, 2 Drawing Figures

METHOD FOR REDUCING HEAT LOSS IN A BOTTLE CLEANING MACHINE

Figure 1:
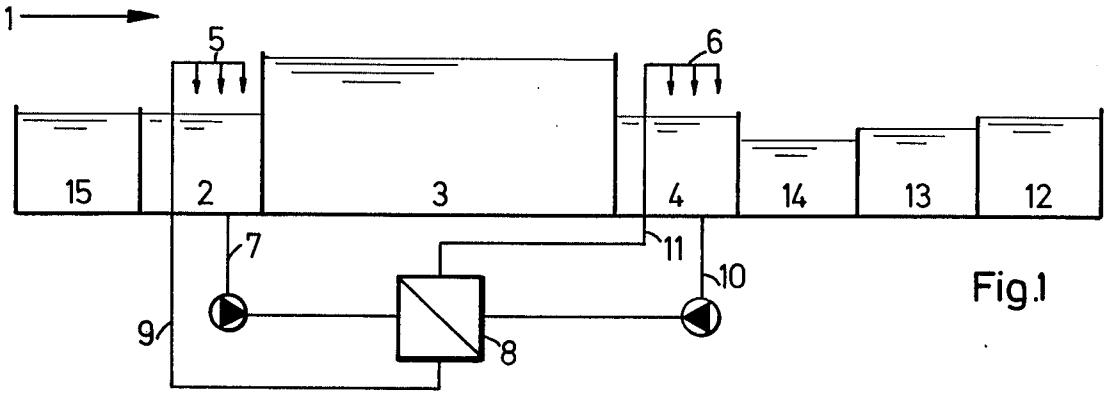

This is a continuation of application Ser. No. 230,068, filed Jan. 29, 1981, now abandoned.

The invention relates to a method and the installation corresponding thereto for the reduction of the heat loss occurring due to revolving vessel carriers in bottle cleaning machines with several treatment baths of different temperature, arranged one behind the other, which are traversed by the vessel carriers.

Cleaning machines of this kind consist of a plurality of treatment baths and stations, located one behind the other, in which the vessels are treated with media of different temperature. Thereat, there is the problem that the vessel carriers with the bottles are considerably heated in the area of the lye bath and transfer this heat into the subsequent machine sections. Hereby there occur not unsubstantial heat losses which, particularly in areas of low temperature, cause an undesired heating of the corresponding stations, whereby the heat balance of such machines is considerably disturbed.

These drawbacks occur mainly then, when one departs from the known low temperature cleaning machines and chooses a high temperature cleaning machine, the lye bath treatment temperature of which can definitely be in the range between 80° and 90° C. In these machines, in particular, a limitation of the heat loss is of special importance.

For this reason the invention has given itself the task of permitting, in particular in high temperature cleaning machines, the occurrence of as slight as possible radiation and heat losses, whereat the heat losses caused by the vessels and/or vessel carriers are to be reduced to a minimum as a result of constant carry-off.

This task is solved according to the invention in an installation of the kind cited in the introduction thereby that the heat absorbed by the vessel carriers in the actual lye treatment bath is withdrawn from these heating vessels in the area of a re-cooling zone after they have traversed this bath, and is imparted to the subsequent vessel carriers located in front of the lye bath in the throughflow direction, for the purpose of heating.

It has proven expedient thereat that the vessel carriers exiting from the lye bath are showered with a cooling liquid in a re-cooling zone by means of a shower system and the heat transferred to the cooling liquid is transferred to the circulating liquid of a pre-heating stage in which a heating-up of subsequent vessel carriers takes place.

Further features of the invention follow from the claims.

With the proposed methodological solution, the problems, occurring in particular in high temperature cleaning machines in view of the unavoidable heat carry-off, are substantially eliminated so that lye baths with higher treatment temperature can now be used economically.

The invention is elucidated in detail, below, with the help of the embodiment examples represented in the drawings.

Figure 2:
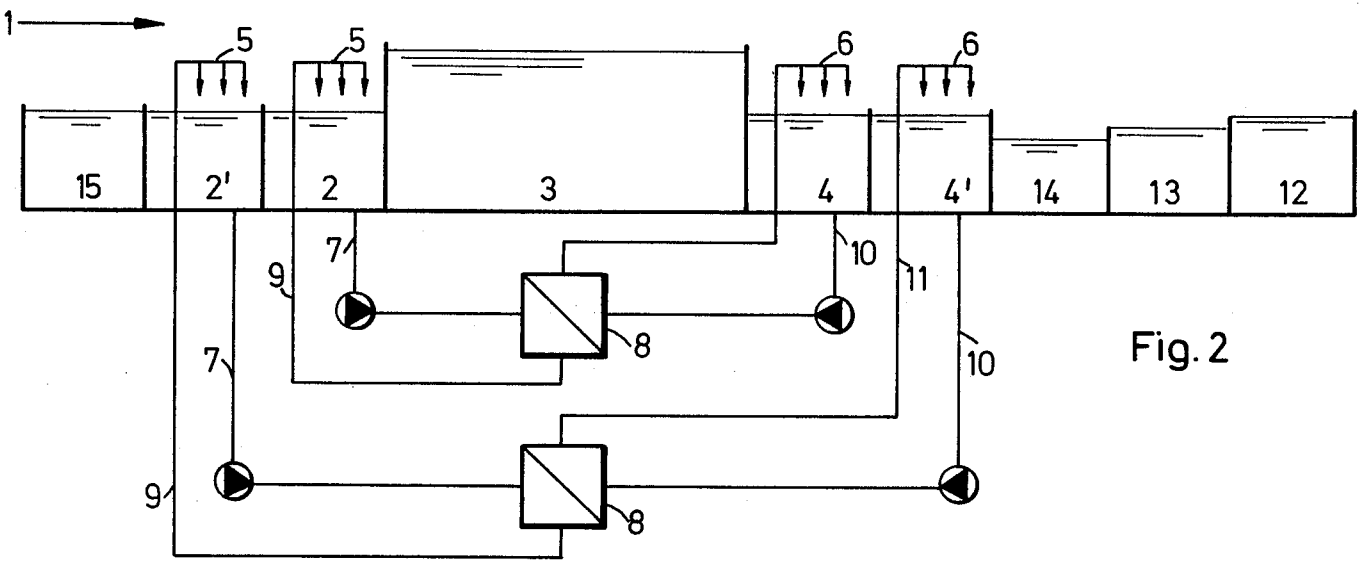

In the drawings:

FIG. 1 shows the course of a heat recovery stage in a single-stage embodiment and FIG. 2 shows a two-stage heat recovery.

The vessel carriers which are not further represented traverse the also only partially represented vessel treatment machine in the direction of the arrow 1. The vessel carriers thereat reach a pre-heating zone 2 with an adjacent lye bath 3 and a re-cooling zone 4 arranged therebehind. Above the pre-heating zone 2 and the re-cooling zone 4 there is arranged a shower system 5 and 6 which showers the vessel carriers and vessels substantially over their whole surface. This produces a heat transfer. The shower system 5 is fed from the pre-heating zone 2 which, for this purpose, has a conduit system 7 which is connected with a countercurrent apparatus 8. From this countercurrent apparatus the actual shower liquid conduit 9 leads to the shower system 5. A corresponding conduit line 10,11 has the re-cooling zone 4, the shower system 6 of which is supplied by means of a conduit 11 which is also interconnected with the countercurrent apparatus 8 as an actual heat exchanger. Taking into account the flow diagram represented in FIG. 1, the heat absorbed by the vessel carriers in the area of the lye treatment bath 3 is withdrawn after traversing this bath by the action of the shower liquid of the shower system 6 and is imparted to the vessel carriers located in front of the leaching bath in the throughflow direction. In this manner, the relatively cold vessel carriers located in front of the lye bath are heated up along with the bottles located therein and arrive at the actual lye bath 3 with a suitable pre-heating temperature. In the re-cooling zone 4, the vessel carriers are accordingly cooled down, so that the losses occurring, in particular in high temperature cleaning machines, due to excessive heat carry-off up to the last treatment stations are avoided.

According to the embodiment example represented in FIG. 2, there can be seen a two-stage heat recovery according to the above-described system. The actual heat recovery stage represented in FIG. 1 is accordingly laid out twofold, the pre-heating zone being formed of two baths 2 and 2' and the re-cooling zone 4 being formed of the baths 4 and 4'. The rinsing water flow is undertaken in the opposite direction of the vessel throughflow direction and takes place cascade-like through the baths 12, 13 and 14 until the bath 15. The bath of the pre-heating zone 2 and of the re-cooling zone 4 are constructed for example as stationary baths.

As per FIG. 2, the number of the heat recovery stages can be increased as desired, in such a way that the heat requirement of the above-mentioned high temperature cleaning machine can be further reduced.

I claim:

1. Method of reducing the heat loss occurring in moving bottles and vessel carriers in bottle cleaning machines containing several treatment baths at different temperatures, arranged one behind the other with the bottles and vessel carriers passing, in turn, through the baths, and the baths including a lye treatment bath with a temperature in the range of 80° to 90° C., characterized therein by arranging a pre-heating zone immediately upstream from the lye treatment bath and a re-cooling zone immediately downstream from the lye treatment bath in the direction of the movement of the vessel carriers so that the bottles and vessel carriers pass directly from the pre-heating zone into the lye treatment bath and from the lye treatment bath directly into the re-cooling zone, showering a first liquid over the bottles in the vessel carriers in the pre-heating zone for heating the bottles about to enter the lye treatment bath, collecting the showered first liquid in the pre-heating zone, showering a second liquid over the bottles in the vessel carriers in the re-cooling zone for cooling the bottles after their passage through the lye treatment bath, collecting the showered second liquid in the re-cooling zone, removing the first liquid collected in the pre-heating zone to a location exterior of the pre-heating zone, the lye treatment bath and the re-cooling zone, removing the second liquid collected in the re-cooling zone to the location exterior of the re-cooling zone, the lye treatment bath and the pre-heating zone at the exterior location passing the removed first liquid from the pre-heating zone in indirect heat transfer relation with the removed second liquid from the re-cooling zone for heating the first liquid and cooling the second liquid and returning the heated first liquid to the pre-heating zone and showering the bottles and vessel carriers in the pre-heating zone with the heated first liquid and returning the cooled second liquid to the re-cooling zone and showering the bottles and vessel carriers in the re-cooling zone with the cooled second liquid whereby the heat removed from the re-cooling zone is used for pre-heating the bottles and vessel carriers in the pre-heating zone before entering the lye treatment bath and the cooled second liquid is used to cool the bottles and vessel carriers in the re-cooling zone so that heat losses due to excessive heat carry-off are avoided.

2. Method according to claim 1, characterized therein by flowing rinsing water in a cascade-like manner into a number of rinsing baths located downstream from the re-cooling zone and commencing the flow of the rinsing water with the rinsing bath located furthest downstream from the lye treatment bath and flowing the rinsing water in the direction opposite to the bottle and vessel carrier movement and providing a stationary bath in the pre-heating zone and the re-cooling zone.

* * * * *